United States Patent [19]

Knorreck

[11] 4,289,101

[45] Sep. 15, 1981

[54] CENTRIFUGAL RPM GOVERNOR FOR INTERNAL COMBUSTION ENGINES

[75] Inventor: Peter Knorreck, Weissach, Fed. Rep. of Germany

[73] Assignee: Robert Bosch GmbH, Stuttgart, Fed. Rep. of Germany

[21] Appl. No.: 129,920

[22] Filed: Mar. 13, 1980

[30] Foreign Application Priority Data

Apr. 26, 1979 [DE] Fed. Rep. of Germany ..... 2916869

[51] Int. Cl.[3] ..... F02D 1/04

[52] U.S. Cl. ..... 123/364; 123/372; 74/3.2; 192/105 C; 192/105 CE

[58] Field of Search ..... 123/364, 365, 366, 367, 123/368, 369, 370, 371, 372, 373, 374–377, 378–393; 74/572, 573, 574, 3.2, 3; 192/105 C, 105 CE, 105 CS, 105 CD

[56] References Cited

U.S. PATENT DOCUMENTS

| | | | |
|---|---|---|---|
| 1,143,347 | 6/1915 | Baird | 123/364 |
| 2,115,277 | 4/1938 | Nutt | 192/105 C |
| 2,272,726 | 2/1942 | Sanders | 123/366 |
| 3,841,285 | 10/1974 | Muller | 123/364 |
| 4,235,212 | 11/1980 | Hebb | 123/365 |

FOREIGN PATENT DOCUMENTS

| | | |
|---|---|---|
| 840261 | 7/1960 | United Kingdom . |
| 843096 | 8/1960 | United Kingdom . |
| 887736 | 1/1962 | United Kingdom . |

*Primary Examiner*—Charles J. Myhre
*Assistant Examiner*—Carl Stuart Miller
*Attorney, Agent, or Firm*—Edwin E. Greigg

[57] ABSTRACT

A centrifugal rpm governor for internal combustion engines is proposed, the flyweights of which are so embodied as to attain both inexpensive mass production thereof and favorable distribution of physical mass. The mass of the flyweight supported on a flyweight carrier is preferably manufactured of sintered steel and one of each are firmly screwed on a lever arm of a bell crank manufactured of sheet steel. These lever arms are embodied as angle brackets which are open toward the flyweight carrier, the mutually parallel arms of which bracket laterally enclose the flange of the flyweight carrier. A crosspiece which connects the two parallel arms has an end face oriented away from the bearing bores of the bell crank and disposed, in the resting position of the flyweight, at least approximately perpendicularly to the longitudinal axis of the rpm governor and against which end face the flyweight mass is firmly screwed by means of securing screws stressed up to the yielding-stress threshold.

6 Claims, 5 Drawing Figures

CENTRIFUGAL RPM GOVERNOR FOR INTERNAL COMBUSTION ENGINES

BACKGROUND OF THE INVENTION

The invention relates to a centrifugal rpm governor for internal combustion engines as described in the preamble to the main claim. A centrifugal rpm governor of this general type is already known (Swiss Pat. No. 231,322), in which the flyweight mass of the flyweight, which is embodied as bent at an angle, is firmly screwed to a lever arm of a bell crank, the lever arm being disposed approximately parallel to the longitudinal axis of the governor. The lever arm which supports the flyweight mass represents the extreme radial limitation of the centrifugal rpm governor; accordingly, its outer contour must at least partially approximate a cylindrical jacket, if the full diameter of the circle described by the flyweight is to be utilized in optimal fashion. For this reason, this bell crank is preferably made from a forged or cast steel part and then subjected to appropriate further processing. The result is that tedious and expensive processing is required merely for the bell crank alone, and this results in high manufacturing costs overall. The known governor type has the further disadvantage that the lever arm carrying the flyweight mass, which protrudes over the entire length of the flyweight, is susceptible to denting and bending and is unable to transmit large centrifugal forces; the possible usage of this governor is accordingly quite limited.

Other known flyweights in angled form for centrifugal rpm governors in internal combustion engines are defects, such as porous areas in the flyweight masses, are recognized in a simple manner, and a form lock in the connection between the flyweight mass and the bell crank is superfluous.

As a result of the characteristics of claim 3, the mounting of the flyweight mass is simplified; and the angle of outward movement under centrifugal force of the flyweight can be limited by the characteristics of claim 4. As a result of the connection disclosed in claim 5 between the arms of the bell crank and the bearing bolts, the flyweights are capable of withstanding extreme stresses, are reliably secured, and are supported in a manner particularly unlikely to cause wear. Hot riveting attains an intended initial stress in the bell crank which still further improves the resistance to stress of the bell crank.

As a result of the characteristics of claim 6, no further processing is required for the flyweight mass except for the cutting of threads, and the magnitude of the centrifugal force exerted by the flyweight can be determined by the choice of the substance from which it is to be made and of the thickness of this substance.

The invention will be better understood and further objects and advantages thereof will become more apparent from the ensuing detailed description of two preferred exemplary embodiments taken in conjunction with the drawings.

This high initial mechanical stressing of the securing screws 19 is attained by means of the so-called "yielding-stress threshold tightening method". This method permits the choice of screws of relatively small dimensions and results in the highest possible resistance to loosening on the part of the securing screws, because during yielding-stress threshold tightening the tightening torque is of secondary importance, and the effect of friction is also not involved. (On this method, see the article, "Optimale Schraubverbindung in der Werkstatt" [Optimal Screw Fastening in the Workshop] in the journal *VDI-Nachrichten,* No. 9, Mar. 2, 1979, page 4.) This method has the further advantage that, as a result of the electronically monitored tightening, defects in the flyweight mass substance become recognizable, because in this case the theoretical tightening torque is not attained. For instance, porous areas (hollow spaces) can be detected in flyweight masses 18 manufactured from cast metal, as can defects resulting from insufficient thickness in flyweight masses 18 manufactured from sintered steel. From the standpoint of molding and stability, the sinter-press method is very advantageous, because in mass production it produces inexpensive and exact parts. Sufficient stability is attained in sintered steel parts having a thickness, for example, of $\leqq 6.9$ kp/cm$^2$.

Figure 1:
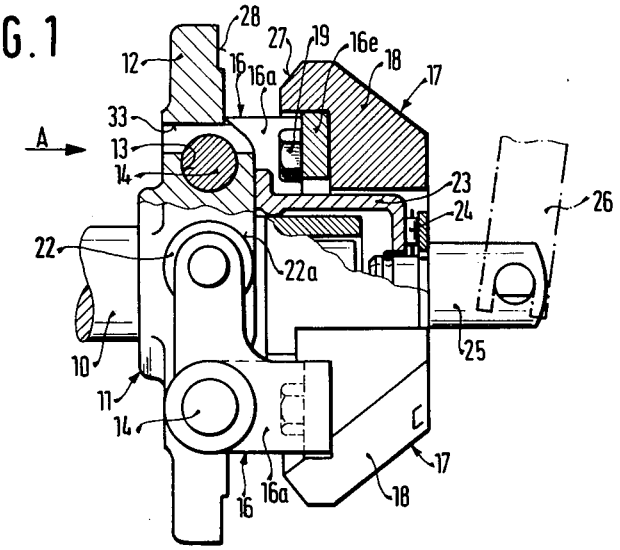
FIG. 1 is a side view, partially in cross-section taken along the line I—I of FIG. 2, of the structural compoone of the bearing bores 15 which act as bearing points. The crosspiece 16e connecting the two arms 16c and 16d has an end face 16f, which faces away from the bearing bores 15 and extend, in the resting position of the flyweights 17 (see FIG. 1), at least approximately perpendicularly relative to the longitudinal axis of the rpm governor. The flyweight mass 18 is firmly fastened by the securing screws 19 to the end face 16f (see FIG. 3) under extremely high initial mechanical stress, designed to be at the yielding-stress threshold of the substance from which the screws are made.
Figure 3:
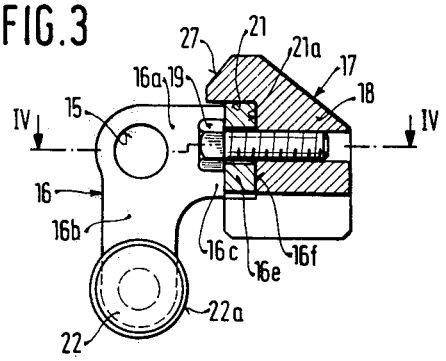
Figure 4:
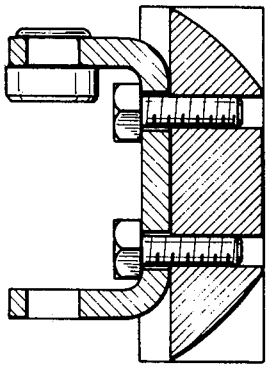

The flyweight mass 18 is provided with a groove 21 (see FIG. 3) which extends over the crosspiece 16e of the bell crank 16. The base 21a of the groove 21 is fastened securely against the end face 16f of the crosspiece 16e of the bell crank 16, as a result of which the mounting position of the flyweight mass 18 is fixed in a form-locking manner. The groove 21 does not, however, perform a holding function, because the entire holding force produced by the yielding-stress limit tightening of the securing screws 19 is exerted between the frictionally engaged groove base 21a and the end face 16f. While one arm 16d of the lever arm 16a of the bell crank 16 carries only the bearing bore 15, the other arm 16c is connected to a second lever arm 16b, which has a cap bolt 22 on its free end. The centrifugal force of the flyweights 17 is transmitted to a governor sleeve 23 (for this element, see again FIG. 1) via the hardened, precision-turned jacket surface 22a of the cap bolt 22.

The governor sleeve 23 transmits the governor motion of the flyweights 17 onto a governor lever 26 of the governor via a pressure bearing 24, embodied by an axial needle bearing, and a compression bolt 25. (The governor lever 26 is indicated here only by dot-dash lines.)

The flyweight mass 18 has an oblique stop face 27 acting as the stroke stop, which is inclined at an angle corresponding to the pivoting angle and oriented toward the flange 12 of the flyweight carrier 11. The stop face 27 cooperates with a counterpart stop face 28 on the flange 12 of the flyweight carrier 11.

Figure 5:
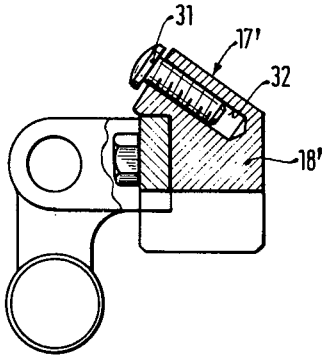

In a flyweight 17' shown in partial section in FIG. 5 and belonging to a second exemplary embodiment which is not further illustrated, the stroke stop which cooperates with the counterpart stop face 28 of the flyweight carrier 11 is embodied by a stop screw 31, which is inserted, in a positionally secured manner, into a threaded bore 32 of the flyweight mass 18' of the flyweight 17'. The means of securing the stop screw 31 against twisting may be, for example, a fluid, glue-like anti-twisting means or some other known securing means. Naturally, instead of the stop screw 31, correspondingly embodied stop bolts can also be secured in the flyweight mass 18', the effective length of which can be varied by providing various lengths of the cap which protrudes beyond the flyweight mass 18' or by interposing support discs, in order to vary the desired pivoting angle of the flyweight 17'.

Figure 2:
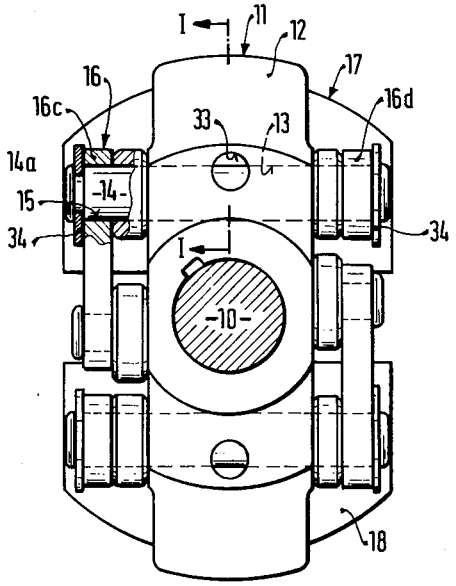

As may be clearly seen in FIG. 2, the two arms 16c and 16d of the bell crank 16 are firmly connected to the bearing bolt 14 in the area of their bearing points 15 by means of hot riveting. The bearing bolt 14, in turn, is rotatably supported in the transverse bore 13 on the flange 12 of the flyweight carrier 11. This type of connection has two advantages: the bearing bolts 14 and thus the flyweights 17' are supported over a sufficiently broad bearing length in the transverse bore 13, and the transverse bore 13 is also lubricated, via a bore 33 which serves to supply lubricating medium in the flange 12 of the flyweight carrier 11. Furthermore, the hot rivet connection, which takes place with interposed hardened discs 34, prevents the bracket-like lever arm 16a of the bell crank 16 from spreading apart under the effect of the forces of acceleration, which arise especially at high rpm levels and which engage the bell cranks. This type of connection simplifies the economical manufacture of the bell cranks 16, because the wall thickness thereof can be chosen to be so thin that the bell cranks 16 can be stamped out of sheet steel and then subsequently bent into shape.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A centrifugal rpm governor for internal combustion engines, having at least two flyweights the mass of each of which is embodied as a separately manufactured part, and fastened firmly by securing screws to one lever arm of a bell crank, the other lever arm of which engages a governor sleeve and includes a bearing point in the region of the connection between said two lever arms, each flyweight being pivotably supported via a bearing bolt on a flange of a flyweight carrier, characterized in that one of said lever arms of said bell crank is embodied as an angle bracket open toward said flyweight carrier, said angle bracket having mutually parallel arms which laterally enclose said flange of said flyweight carrier and each of said parallel arms having a bearing bore which functions as a bearing point and said angle bracket further including a cross-piece which connects said two parallel arms, said cross-piece having an end face oriented away from said bearing bores, said end face further being firmly screwed to said flyweight mass with extremely high initial mechanical stress, and further wherein said flyweight mass is at the yielding-stress threshold of the substance from which said securing screws are made.

2. A centrifugal rpm governor as defined by claim 1, characterized in that the high initial mechanical stressing of said securing screws is attainable by means of yielding-stress threshold tightening.

3. A centrifugal rpm governor as defined by claim 1, characterized in that said flyweight mass further includes plural portions each of which has a recessed area that extends over said cross-piece, said recessed area of each of said plural portions of said flyweight mass being fastened against said end face of said cross-piece.

4. A centrifugal rpm governor as defined by claim 1, characterized in that at least one of said portions of said flyweight mass further includes a stroke stop means which cooperates with said flange of said flyweight carrier and further that said stroke stop means includes a stop screw adjustably threaded into said flyweight mass.

5. A centrifugal rpm governor as defined by claim 1, characterized in that said two mutually parallel arms of said bell crank are firmly connected in said bearing bores by means of hot riveting of a bearing bolt which is rotatably supported in a transverse bore of said flange of said flyweight carrier.

6. A centrifugal rpm governor as defined by claim 1, characterized in that said flyweight mass is manufactured from sintered steel.

* * * * *